US006804931B2

(12) United States Patent
Pike

(10) Patent No.: US 6,804,931 B2
(45) Date of Patent: Oct. 19, 2004

(54) CARTON FILLING DEVICES

(75) Inventor: Brian Charles Pike, North Somerset (GB)

(73) Assignee: Bradman Lake Limited, Bristol (GB)

( * ) Notice: Subject to any disclaimer, the term of this patent is extended or adjusted under 35 U.S.C. 154(b) by 0 days.

(21) Appl. No.: 09/725,466

(22) Filed: Nov. 30, 2000

(65) Prior Publication Data

US 2001/0002531 A1 Jun. 7, 2001

(30) Foreign Application Priority Data

Dec. 1, 1999 (GB) ..... 9928230

(51) Int. Cl.[7] ..... B65B 39/00
(52) U.S. Cl. ..... 53/252; 53/256; 53/258
(58) Field of Search ..... 53/252, 256, 258, 53/251, 237, 273; 198/456, 457, 474.1, 732, 598, 430

(56) References Cited

U.S. PATENT DOCUMENTS 3,906,705 A * 9/1975 Beck et al. ..... 53/252
4,380,283 A * 4/1983 Van Maanen
4,804,076 A * 2/1989 Pace ..... 198/475.1
4,936,077 A * 6/1990 Langen et al. ..... 53/252
5,052,544 A 10/1991 Anderson
5,339,944 A 8/1994 Ostholt et al.
5,430,990 A * 7/1995 Long ..... 53/252
5,457,941 A * 10/1995 Long et al. ..... 53/252
5,579,895 A * 12/1996 Davis et al. ..... 198/456
5,611,193 A * 3/1997 Farrelly ..... 53/252
5,752,593 A * 5/1998 Miyamoto et al. ..... 198/456
6,607,068 B1 * 8/2003 Walther et al. ..... 198/456
6,669,012 B1 * 12/2003 Yoshida et al. ..... 198/890

* cited by examiner

*Primary Examiner*—Eugene Kim
*Assistant Examiner*—Sameh H. Tawfik
(74) *Attorney, Agent, or Firm*—Young & Thompson

(57) ABSTRACT

A carton filling device incorporates a conveyor 1 for moving cartons 3 and objects 2 to be located in the cartons simultaneously down a track with the objects respectively facing opposite to open ends of the cartons located at one side of the conveyor, A control arm 5 is situated in a start position at the other side of the conveyor and carries pushers for engaging the objects 2 and pushing them towards and into the open ends of the cartons 3. A control mechanism is adapted to move the control arm 5 not only across the conveyor 1, but also down the conveyor at the same speed of movement as the conveyor and to return the control arm 5 back to the start position once the objects have been inserted into the cartons.

5 Claims, 4 Drawing Sheets

CARTON FILLING DEVICES

FIELD OF THE INVENTION

This invention is concerned with means for inserting objects being carried on a conveyor into cartons which move along with the conveyor. A standard mechanism for this purpose has a series of pushers which are moved across the conveyor to move objects into the respective cartons, the pushers then being carried around to the start end of the conveyor to locate on to further objects to be inserted. This mechanism has a large number of moving parts in view of the fact that several independent moving pushers are employed and occupies a substantial width to one side of the conveyor, for location of the pushers in their extended state.

SUMMARY OF THE INVENTION

According to the present invention there is provided a carton filling device comprising a conveyor for moving cartons and objects to be located in the cartons simultaneously down a track with the objects respectively facing opposite to open ends of the cartons located at one side of the conveyor, and a control arm situated in a start position at the other side of the conveyor and carrying pushers for engaging the objects and pushing them towards and into the open ends of the cartons under control of a control mechanism adapted to move the control arm not only across the conveyor, but also down the conveyor at the same speed of movement as the conveyor and to return the control arm back to the start position once the objects have been inserted into the cartons.

With such an arrangement the pushers are moved by means of the control arm essentially diagonally across the track followed by the conveyor and are then brought back, along the same diagonal line, to the start position. Pushers are not carried around with the conveyor as in the previous mechanism.

In the preferred arrangement the pusher arm will carry two to four pushers for engaging respective objects. These pushers are carried by a single control arm of the control mechanism so that the number of relatively moveable parts is kept to a minimum. Preferably the control mechanism is designed to cause the pusher arm to be raised for the return journey back to the start position. This ensures that there is no fouling with parts of the conveyor or further objects to be moved. A support body can be situated beside the conveyor to support the control mechanism which controls the movement of the control arm.

BRIEF DESCRIPTION OF THE DRAWINGS

The invention may be performed in various ways and a preferred embodiment thereof will now be described, by way of example, with reference to the accompanying drawings, in which.

DETAILED DESCRIPTION OF THE INVENTION

Figure 1:
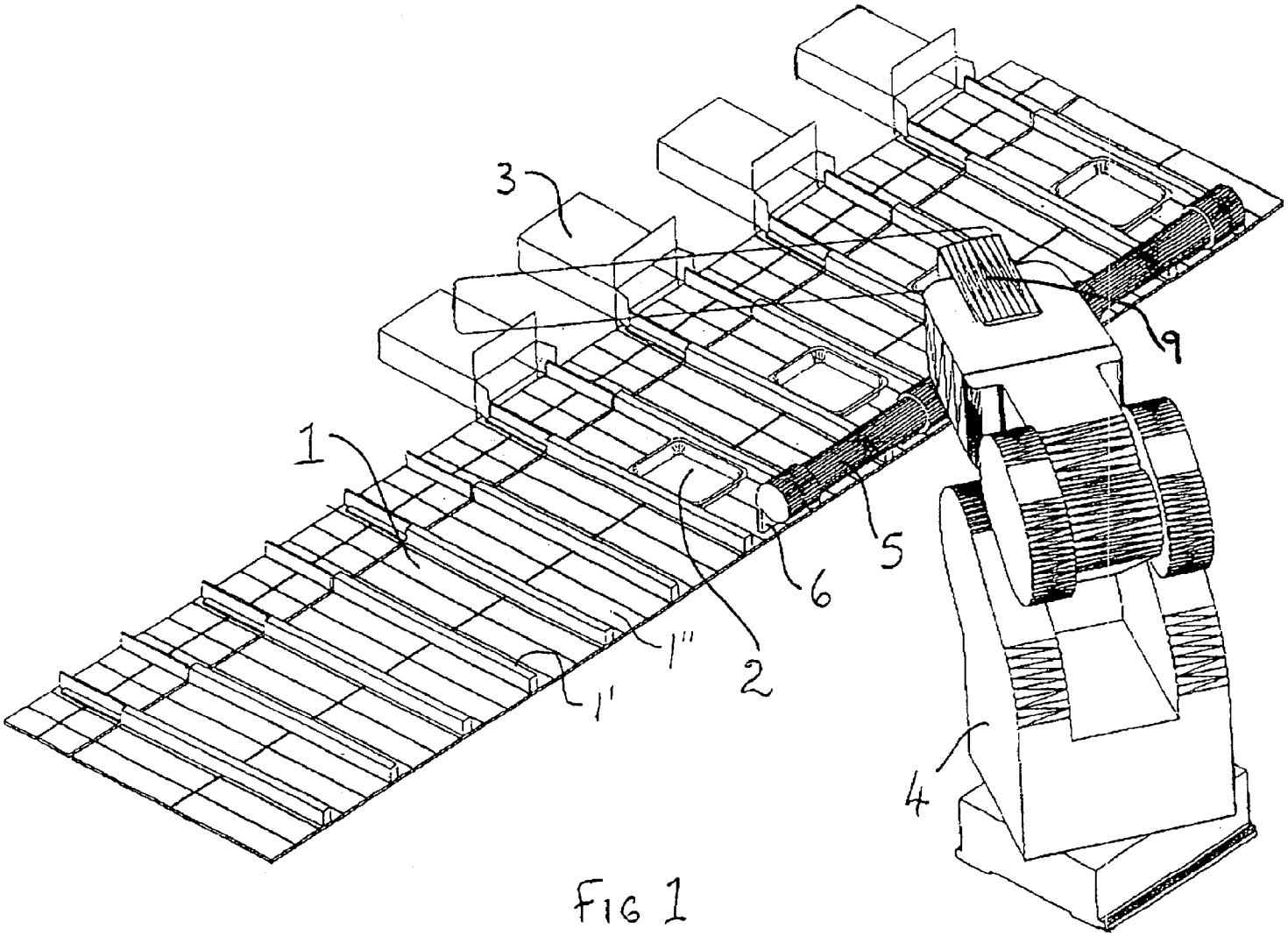
FIG. 1 illustrates a carton filling device of this invention at a start position.

The device shown in the drawings incorporates a conveyor 1 on which are carried for example individual food trays 2 which are to be inserted into open ended cartons 3.

Figure 2:
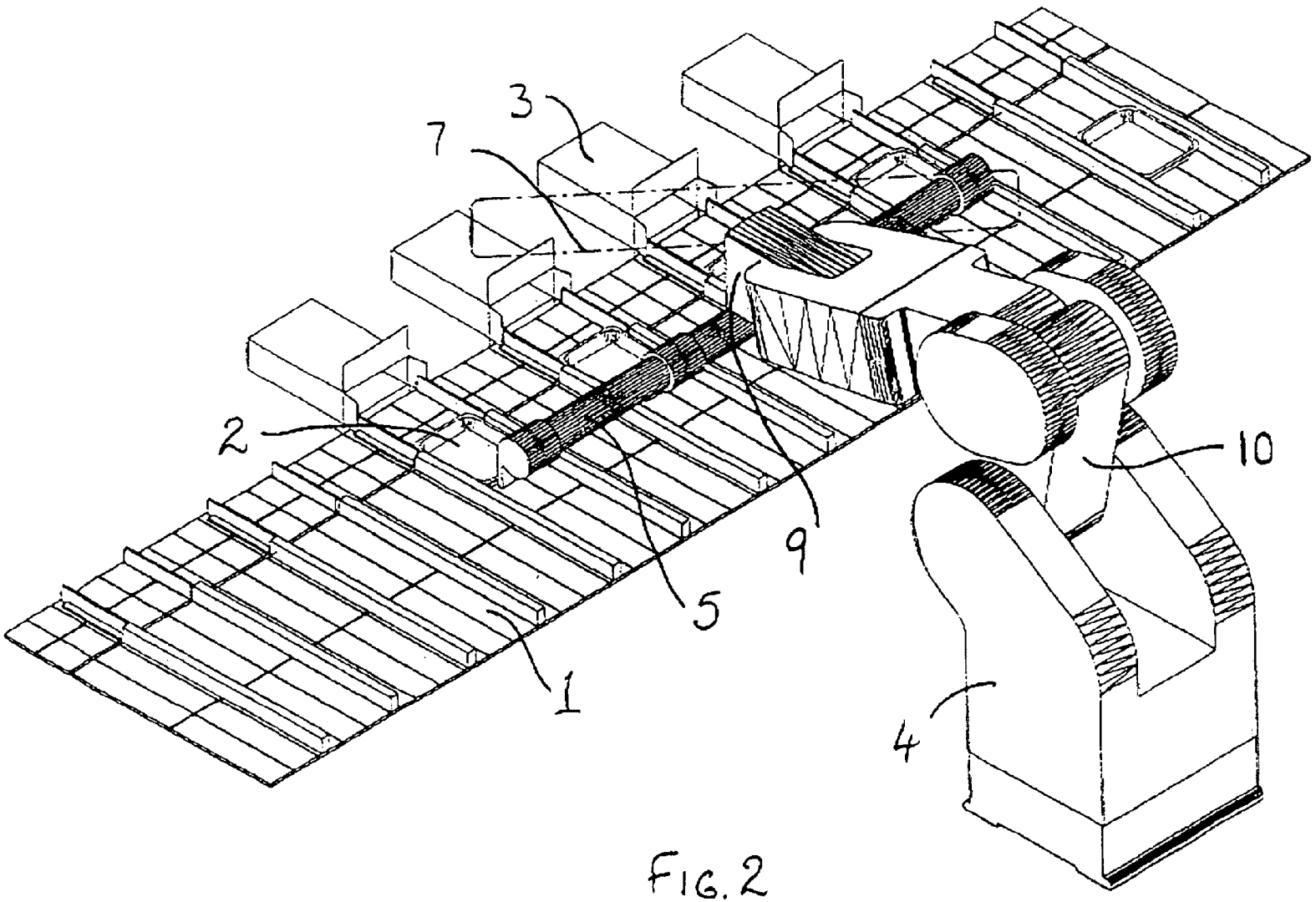
FIGS. 2 to 4 illustrate sequential operational positions of the carton filling device in use in inserting objects into cartons.
Figure 3:
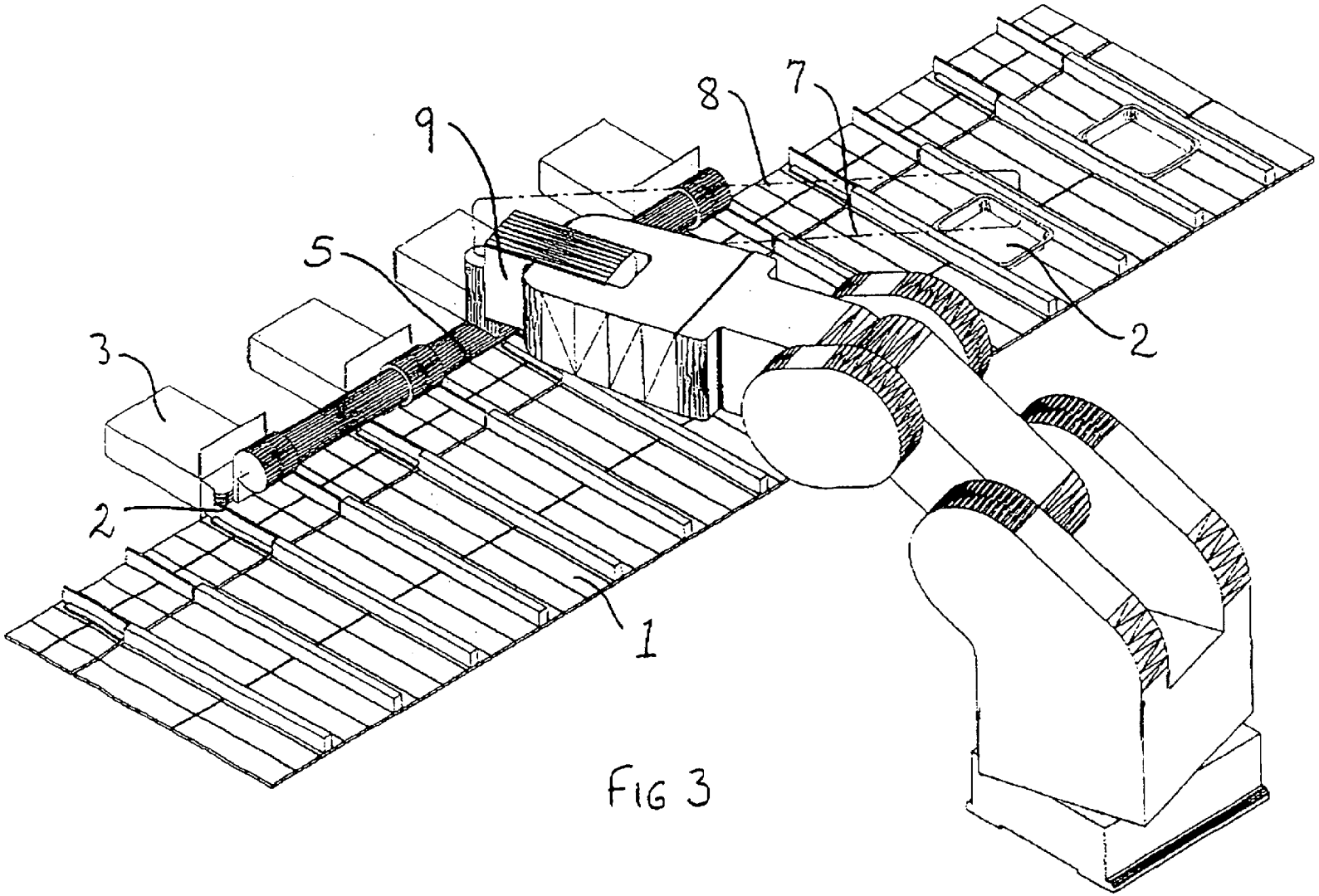
Figure 4:
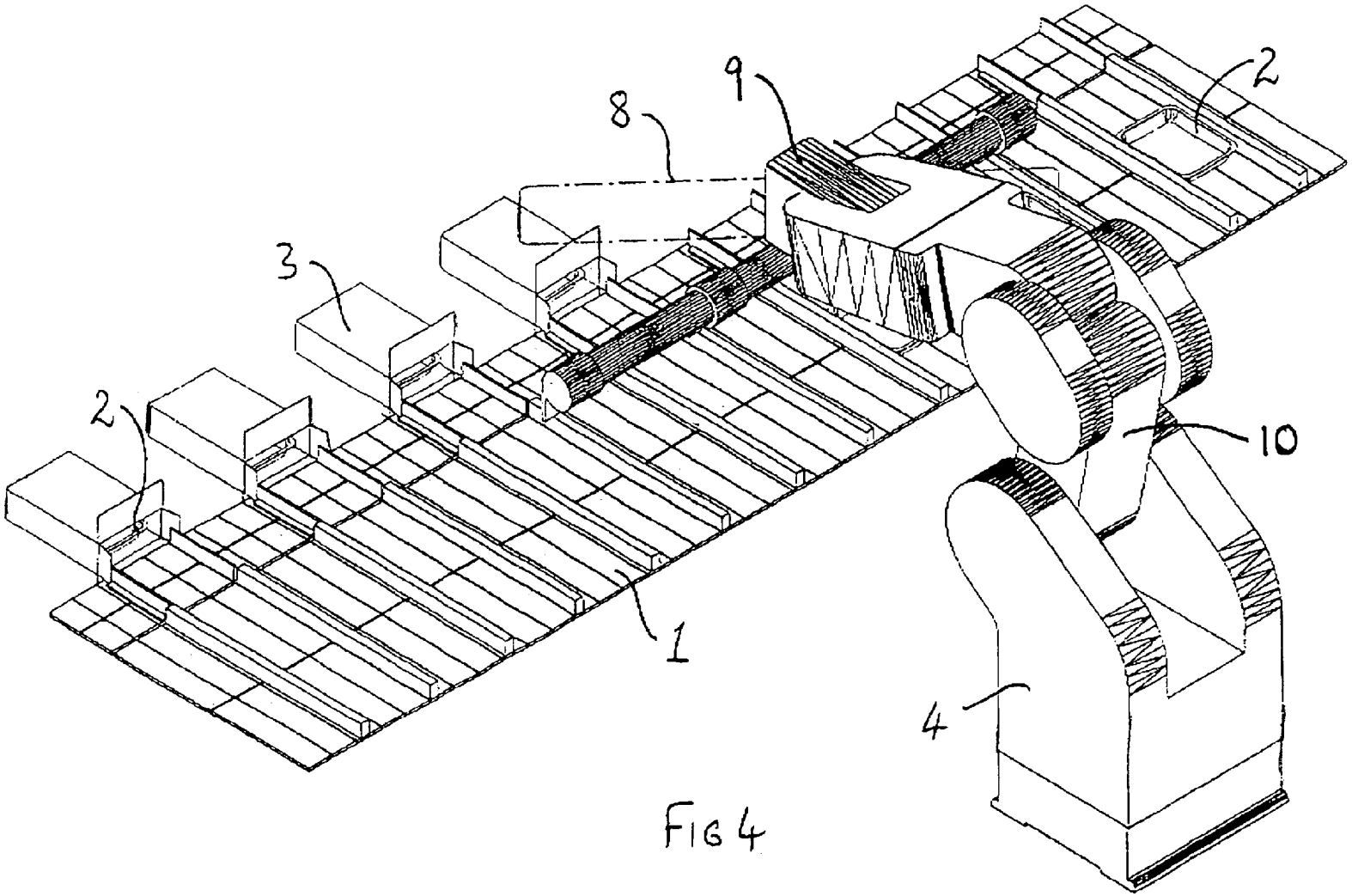

As the conveyor 1 moves from right to left as shown in FIG. 1 the cartons 3 move at the same speed with the conveyor. A robotic support body 4 incorporates a control mechanism arranged to move the support body about suitable rotational axes so as to cause a control arm 5 to be moved across the conveyor 1. The arm 5 incorporates paddles 6 which engage with the trays 2 so as to push the trays towards the cartons 3. The arm 5 is moved across the conveyor 1, but at the same time moves from right to left at the same speed as for the conveyor 1. The diagonal path taken by a head 9 of the support body, carrying the arm 5, is indicated by the broken line 7 as shown in FIGS. 2 and 3. This results in the trays 2 being pushed fully home into the cartons 3. As seen in the drawings, conveyor 1 has upward projections 1' perpendicular to the length of conveyor 1, that define between them paths 1" also perpendicular to the length of conveyor 1, along which paths the trays 2 are pushed by arm 5 into cartons 3. The arm 5 is then raised and the head 9 is brought back along the reciprocal path 8 as shown in FIG. 4 until the arm returns to and is lowered into the start condition as shown in FIG. 1. The same operation can then be employed to move another set of four trays into a subsequent series of four cartons.

The paddles 6 could be designed to be disengaged appropriately in instances where it is not practical to load the trays into the carton, a monitoring device has sensed that there is an oversize product or a badly formed carton. The robotic arm 10 can be fitted with customised gripper attachments to facilitate stacking or tiering of products prior to loading the products into the cartons. The paddles can incorporate a facility to apply downwards or sideways pressure onto the top of the product to ensure that it enters the carton aperture.

What is claimed is:

1. A carton filling device comprising a conveyor having a top surface and provided for moving cartons and objects to be located in the cartons simultaneously down a track with the objects respectively facing opposite to open ends of the cartons located at one side of the conveyor, and a single control arm situated in a start position at the other side of the conveyor and carrying at least two pushers for engaging the objects and pushing them across the top surface of the conveyor towards and into the open ends of separate cartons under control of a control mechanism adapted to move the single control arm in one direction not only across the conveyor, but also down the conveyor at the same speed of movement as the conveyor so that the pushers carried on the control arm are moved across the conveyor in a diagonal direction and to return the control arm in the reverse direction to said one direction back across the top surface of the conveyor to the start position once the objects have been inserted into the cartons.

2. A device according to claim 1, wherein the pusher arm carries two to four pushers for engaging respective objects.

3. A device according to claim 1, wherein the control mechanism is designed to cause the pusher arm to be raised for the return journey back to the start position.

4. A device according to claim 1, wherein a support body situated beside the conveyor supports the control mechanism which controls the movement of the control arm.

5. A carton filling device comprising a conveyor having a top surface and provided for moving cartons and objects to be located in the cartons simultaneously down a track with the objects respectively facing opposite to open ends of the cartons located at one side of the conveyor, means on the top surface of the conveyor defining paths along which said objects are guided by said means to move relative to the conveyor only perpendicular to the direction of movement of the conveyor, and an elongated control arm situated at the other side of the conveyor from the cartons and carrying pusher means for engaging the objects and pushing them across the top surface of the conveyor along said paths toward and into the open ends simultaneously of a plurality of cartons under control of a control mechanism adapted to move the control arm in one direction not only across the conveyor but also down the conveyor at the same speed of movement as the conveyor so that the pusher means carried on the control arm are moved across the conveyor in a diagonal direction and return the control arm back across the top surface of the conveyor to the start position once the objects have been inserted into the cartons, the control arm spanning a plurality of said paths so as simultaneously to fill a plurality of said cartons.

* * * * *